US005485192A

United States Patent [19]

Nagahata et al.

[11] Patent Number: 5,485,192

[45] Date of Patent: Jan. 16, 1996

[54] THERMAL PRINTHEAD

[75] Inventors: Takaya Nagahata; Tokihiko Kishimoto, both of Ukyo, Japan

[73] Assignee: Rohm Co. Ltd., Kyoto, Japan

[21] Appl. No.: 365,241

[22] Filed: Dec. 28, 1994

[30] Foreign Application Priority Data

Dec. 28, 1993 [JP] Japan ..... 5-338115

[51] Int. Cl.[6] ..... B41J 2/335

[52] U.S. Cl. ..... 347/203

[58] Field of Search ..... 347/200, 201, 347/202, 203204, 205, 206

[56] References Cited

U.S. PATENT DOCUMENTS 5,072,236 12/1991 Tatsumi et al. ..... 347/203
5,245,356 9/1993 Ota et al. ..... 347/197

FOREIGN PATENT DOCUMENTS 54-137354 10/1979 Japan ..... B41J 3/20
131476 9/1989 Japan ..... B41J 3/20

*Primary Examiner*—Huan H. Tran
*Attorney, Agent, or Firm*—Michael D. Bednarek

[57] ABSTRACT

A thermal printhead is provided which comprises an insulating head substrate, a conductor pattern formed on the head substrate, a row of heating dots formed on the head substrate in electrical conduction with the conductor pattern, an array of drive ICs mounted on the head substrate and spaced from the row of heating dots, a resin body enclosing the array of drive ICs, and a protective coating covering the conductor pattern together with the row of heating dots. The protective coating comprises a smaller thickness portion at least at the row of heating dots, and a larger thickness portion held in contact with the resin body and extending to a position short of the row of heating dots.

8 Claims, 4 Drawing Sheets

THERMAL PRINTHEAD

BACKGROUND OF THE INVENTION

1. Field of the Invention

This invention relates to a thermal printhead of the type which comprises a row of heating dots covered by a protective coating.

2. Description of the Related Art

As shown in FIG. 5 of the accompanying drawing, a typical prior art thermal printhead 1' comprises an insulating head substrate B' supported on a heat sink plate 2', and a connector circuit board 2' also supported on the heat sink plate. The head substrate 3' is formed with a wiring conductor pattern (not shown), whereas the connector circuit board 4' is also formed with a wiring conductor pattern (not shown) held in electrical contact with the wiring conductor pattern of the head substrate 3' by means of a metallic presser cover 5'.

The head substrate 3' further carries a resistor strip 7' and an array of drive ICs 6' for divisionally activating the resistor strip 7' to generate heat. The resistor strip 7' together with the unillustrated wiring conductor pattern on the head substrate 3' is covered by a protective glass coating (not shown).

In operation for printing, a thermosensitive paper 8' backed up by a platen 9' is held in sliding contact with the unillustrated glass coating at the resistor strip 7'. Thus, static electricity is inevitably generated by such sliding contact. However, since the presser cover member 5' is made of metals the generated static electricity is allowed to escape through the presser cover member 5'.

On the other hand, there is also known a thermal printhead which has no presser cover but is otherwise similar to the one shown in FIG. 5. Such a printhead is advantageous because of a size reduction. However, due to the absence of the metallic presser cover, static electricity frictionally generated at the resistor strip is abruptly discharged to the wiring conductor pattern when the static electricity is charged to a high level. As a result, the drive ICs may be electrostatically damaged.

For solving the above problem, it is conceivable to increase the thickness of the protective glass coating as a whole, thereby preventing an electrostatic discharge through the protective glass coating into the wiring conductor. However, this solution inevitably decreases heat transmission from the resistor strip to the thermosensitive paper, thereby resulting in a deterioration of printing quality.

SUMMARY OF THE INVENTION

It is, therefore, an object of the present invention to provide a thermal printhead which is capable of preventing drive ICs from being electrostatically damaged without decreasing heat transmission from a row of heating dots to a thermosensitive paper or a thermal transfer ink ribbon.

According to the present invention, there is provided a thermal printhead comprising: an insulating head substrate; a conductor pattern formed on the head substrate; a row of heating dots formed on the head substrate in electrical conduction with the conductor pattern; an array of drive ICs mounted on the head substrate and spaced from the row of heating dots; a resin body enclosing the array of drive ICs; and a protective coating covering the conductor pattern together with the row of heating dots; wherein the protective coating comprises a smaller thickness portion at least at the row of heating dots, and a larger thickness portion held in contact with the resin body and extending to a position short of the row of heating dots.

Preferably, the larger thickness portion enters partially into the resin body. Further, it is also advantageous if the protective coating as a whole is made of glass.

According to a preferred embodiment of the present invention, the protective coating comprises a primary layer and a secondary layer formed on the primary layer. In this case, the smaller thickness portion of the protective coating is provided by the primary layer alone, whereas the larger thickness portion of the protective coating is provided by a combination of the primary and secondary layers. The thickness of the primary layer may be in the range of e.g. 4–6 micrometers, whereas that of the secondary layer may be in the range of e.g. 10–20 micrometers. Further, the primary and secondary layers may be equally made of a same glass paste which is printed and baked.

Other objects, features and advantages of the present invention will be fully understood from the following detailed description given with reference to the accompanying drawings.

DETAILED DESCRIPTION OF THE PREFERRED EMBODIMENTS

Figure 1:
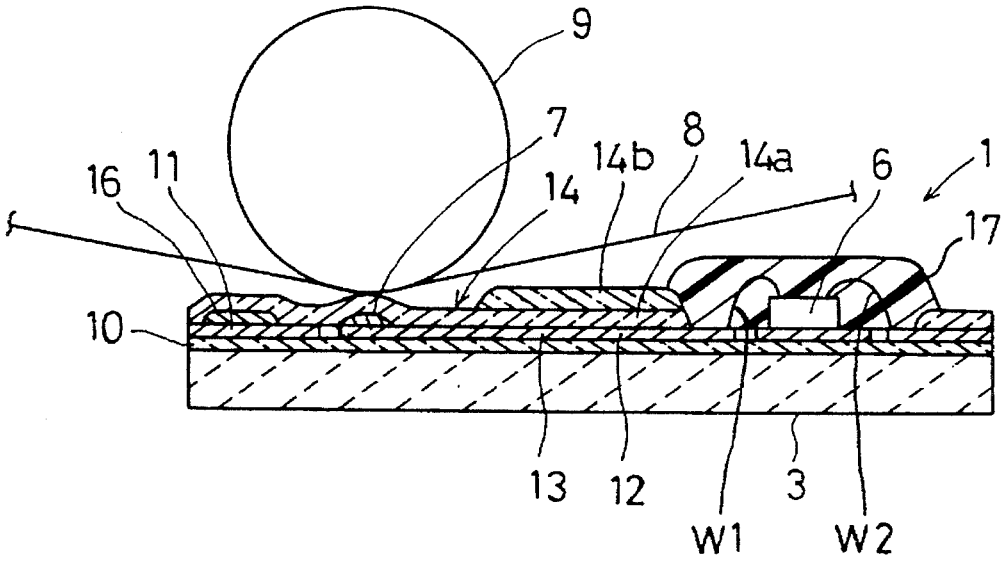
FIG. 1 is a view, in transverse section, showing a thermal printhead embodying the present invention.
Figure 2:
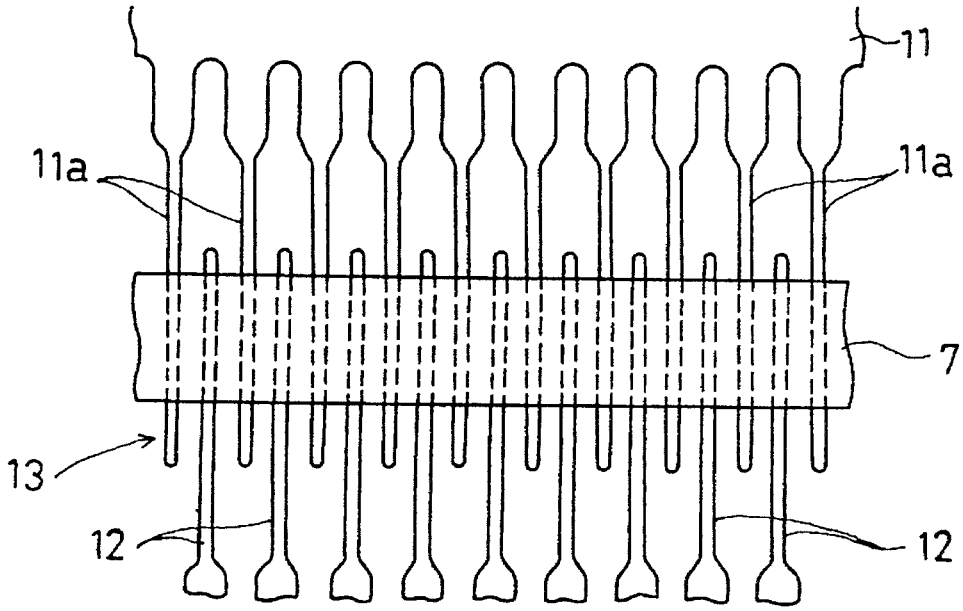
FIG. 2 is an enlarged fragmentary plan view showing a part of a resistor strip together with its associated part of a conductor pattern.

Referring first to FIGS. 1 and 2 of the accompanying drawings, there is shown a thermal printhead 1 embodying the present invention. In use for printing, the printhead 1 may be mounted on a heat sink plate (not shown) or directly on a suitable portion of the printer.

The printhead 1 comprises an insulating head substrate 3 which is formed, on its upper surface, with a heat retaining glaze layer 10. The head substrate 3 may be made of a ceramic material such as alumina, whereas the glaze layer 10 may be made of glass.

The glaze layer 10 carries a conductor pattern 13 which includes a common electrode 11 extending along and adjacent to a longitudinal edge of the head substrate 3. The common electrode 11 has a plurality of teeth 11*a* spaced from each other longitudinally of the head substrate 3, as shown in FIG. 2. The conductor pattern also includes a plurality of individual electrodes 12 spaced from each other longitudinally of the head substrate 3 in staggered relation to the teeth 11*a* of the common electrode 11, as also shown in FIG. 2.

Typically, the conductor pattern 13 may be formed by applying a gold paste to form a conductive layer which is subsequently baked for curing, and thereafter etching the conductive layer in a predetermined pattern by photolithography.

The conductor pattern 13 may have a thickness of one to several micrometers for example.

A resistor strip 7 of a predetermined width is formed longitudinally of the head substrate 3 along the common electrode 11 to lie over the teeth 11*a* of the common electrode and the individual electrodes 12, as shown in FIG. 2. The resistor strip 7 may be made of a ruthenium oxide paste applied in a thick film. A portion of the resistor strip 7 located between each two adjacent teeth 11*a* of the common electrode 11 corresponds to a single heating dot, so that the resistor strip 7 as a whole provides an array of heating dots. Apparently, each of the heating dots is activated for heat generation when an ON signal (drive voltage) is supplied to a corresponding one of the individual electrodes 12.

According to the illustrated embodiment, the common electrode 11 is provided with an auxiliary conductor strip 16 (see FIG. 1) for increasing the current capacity of the common electrode 11. The provision of the auxiliary conductor strip 16 is particularly advantageous when the length of the head substrate 3 (i.e., resistor strip 7) is large. However, the auxiliary conductor strip 16 may be dispensed with if the length of the head substrate 3 is relatively small.

An array of drive ICs 6 (only one shown) is mounted on the head substrate 3 adjacent to the individual electrodes 12. Each of the drive ICs 6 is electrically connected to a corresponding one of the individual electrodes 12 through a bondwire W1. Further, each of the drive ICs 6 is electrically connected to another portion of the conductor pattern 13 through a bondwire W2. The array of drive ICs 6 together with the associated bondwires W1, W2 is enclosed in an protective resin body 17 which may be made of epoxy resin or polyetheramide resin.

The conductor pattern 13 together with the resistor strip 7 and the auxiliary conductor strip 16 is covered by a protective glass coating except for the region of the head substrate 3 used for mounting the array of drive ICs 6. The protective coating 14 may be formed by printing a glass paste containing amorphous Pb—$SiO_2$—$Al_2O_3$ glass frit as a main constituent, and then baking the applied paste for fixation.

According to the illustrated embodiment, the protective coating 14 includes a primary layer 14*a* occupying the entire area of the protective coating 14, and a secondary layer 14*b* extending only from the protective resin body 17 up to a position short of the resistor strip 7. Thus, the thickness of the protective coating 14 is greater in a region between the resistor strip 7 and the protective resin body 17. Preferably, the secondary layer 14*b* together with the primary layer 14*a* partially enters into the protective resin body 17.

The primary layer 14*a* of the protective coating 14*a* may have a thickness (e.g. 2–6 micrometers) which is sufficient for protecting the resistor strip 7. The secondary layer 14*b* may have as large a thickness (e.g. 4–6 micrometers) as is possible by a single printing-baking operation. Of course, the thickness of the secondary layer 14*b* may be further increased by repeating the printing and baking operation.

As shown in FIG. 1, the primary layer 14*a* of the protective glass coating 14 bulges at the resistor strip 7 due to the thickness thereof. Thus, the primary layer 14*a* contacts, at the resistor strip 7, a thermosensitive paper 8 backed up by a platen 9, thereby enabling an intended printing operation.

Figure 3A:
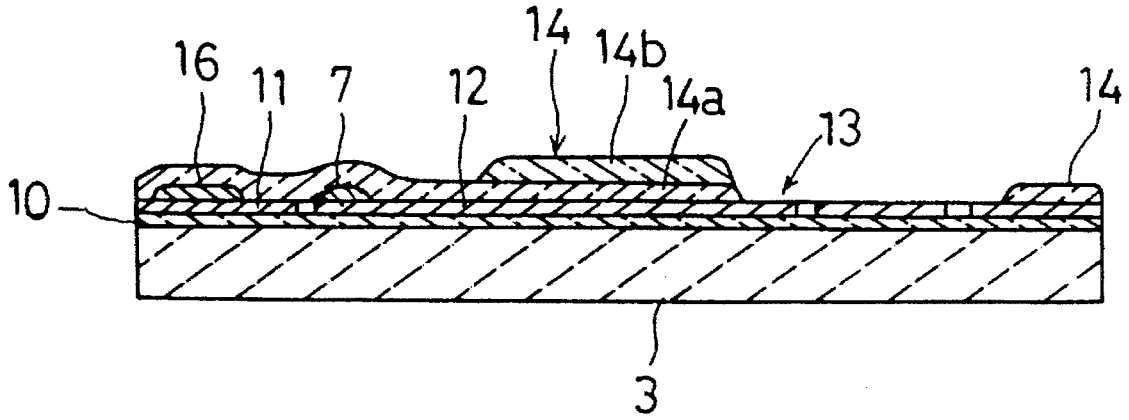
FIGS. 3*a* and 3*b* are sectional views similar to FIG. 1 but showing the successive steps of making the same printhead.

FIG. 3*a* shows the head substrate 3 immediately after formation of the protective glass coating 14 The formation of the primary and secondary layers 14*a*, 14*b* may be performed by applying a same glass paste in two successive steps prior to mounting the array of drive ICs 6. Since the glass paste does not contain an organic solvent, it is unlikely that the IC mounting region of the conductor pattern 13 is contaminated by such a solvent at the time of baking the glass paste.

Figure 3B:
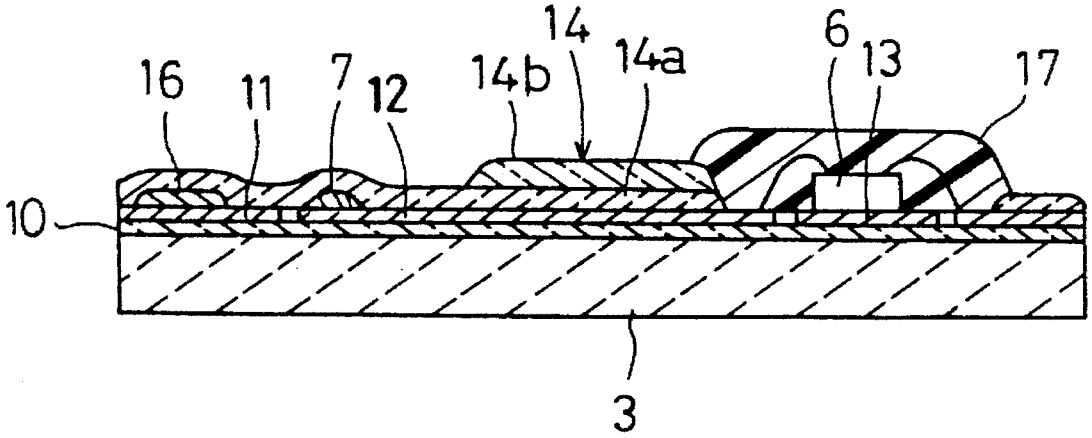
Figure 4:
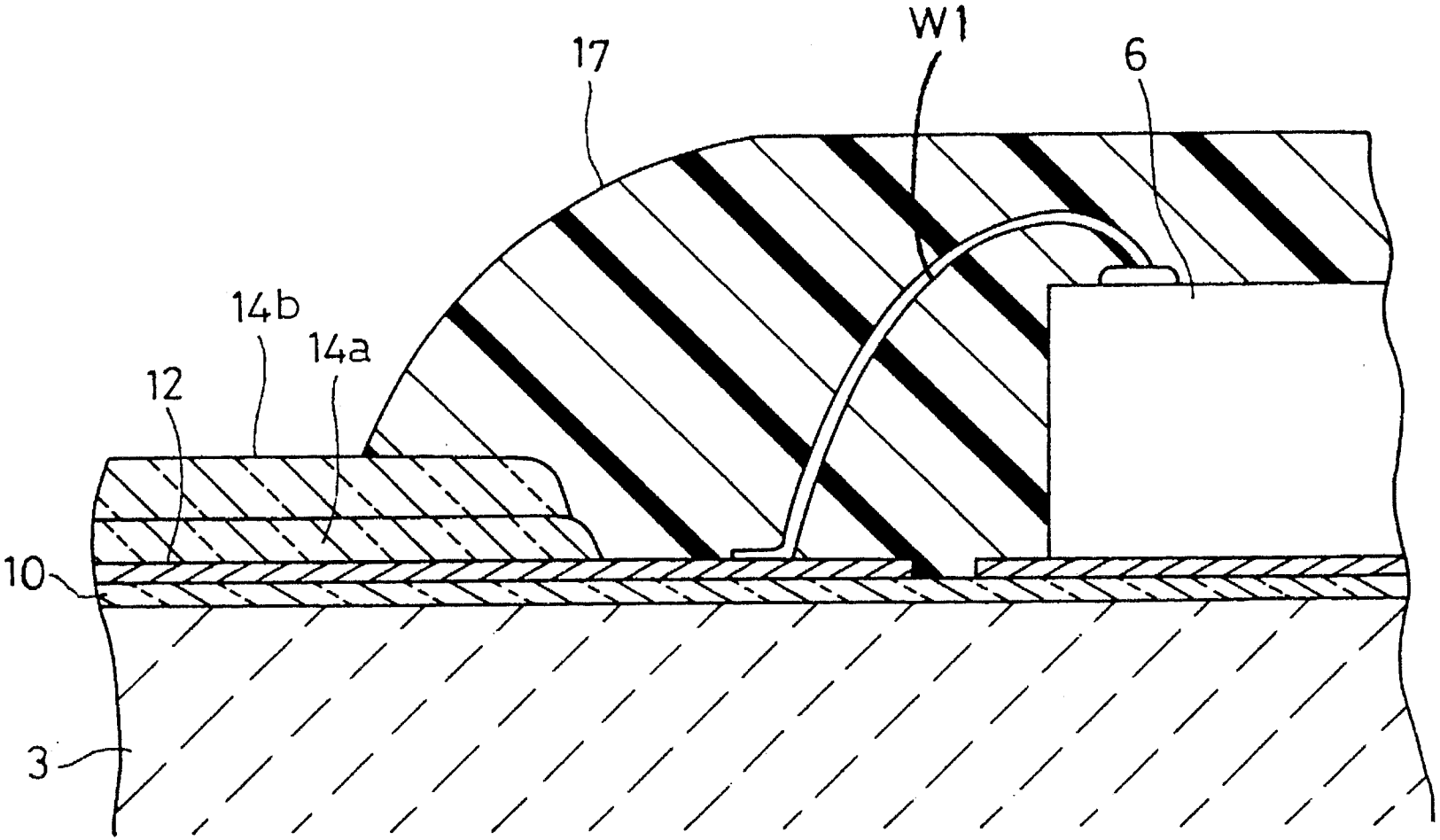
FIG. 4 is an enlarged fragmentary sectional view showing a principal portion of the same printhead.
Figure 5:
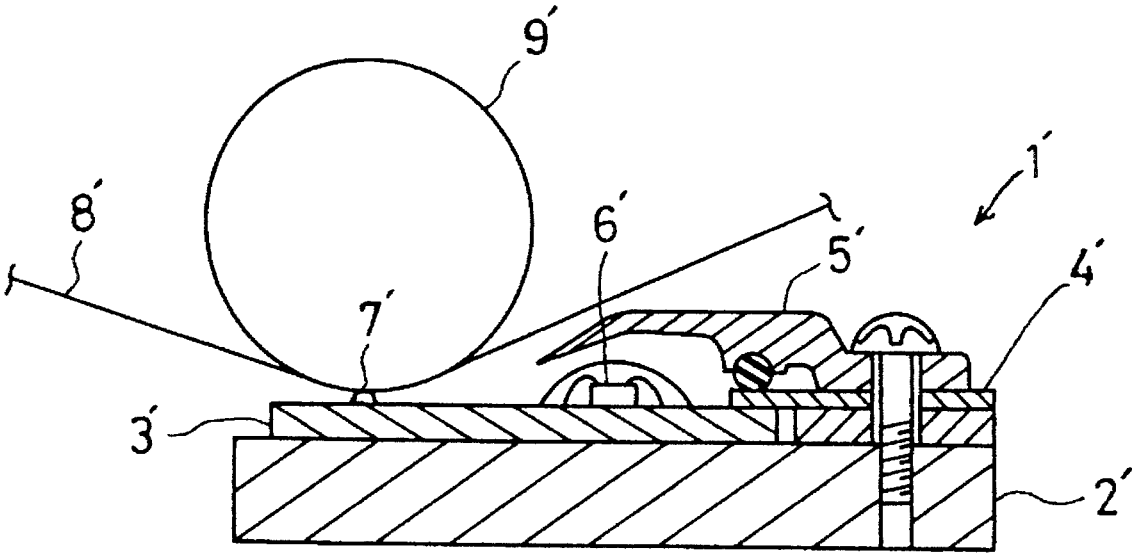
FIG. 5 Prior Art
FIG. 5 is a view, in transverse section, showing a prior art thermal printhead.

After forming the protective glass coating 14, the array of drive ICs 6 is mounted on the head substrate 3 and wire-bonded to the relevant portions of the conductor pattern 13, as shown in FIG. 3*b*. Then, the protective resin body 17 is formed to cover longitudinal edges of the primary and secondary layers 14*a*, 14*b* of the protective glass coating 14, as more specifically shown in FIG. 4.

According to the arrangement of the printhead 1 described above, the protective glass coating 14 is thickened by the provision of the secondary layer 14*b*, so that the insulating ability of the protective glass coating 14 increases between the resistor strip 7 and the array of drive ICs 6. As a result, even if static electricity is generated by frictional contact between the paper 8 and the protective glass coating 14, the drive ICs 6 are prevented from being electrostatically damaged or influenced.

On the other hand, the secondary layer 14*b* of the protective glass coating 14 extends only up to a point short of the resistor strip 7. Thus, the secondary layer 14*b* does not hinder heat transmission from the resistor strip 7 to the thermosensitive paper 8.

The preferred embodiment of the present invention being thus described, it is obvious that the same may be varied in many ways. For instance, the resistor strip 7 may be a thin film, in which case the two layers 14*a*, 14*b* of the protective coating 14 may be formed by sputtering a suitable protective material other than glass. Such variations are not to be regarded as a departure from the spirit and scope of the present invention, and all such modifications as would be obvious to those skilled in the art are intended to be included within the scope of the following claims.

We claim:

1. A thermal printhead comprising:

an insulating head substrate;

a conductor pattern formed on the head substrate;

a row of heating dots formed on the head substrate in electrical conduction with the conductor pattern;

an array of drive ICs mounted on the head substrate and spaced from the row of heating dots;

a resin body enclosing the array of drive ICs; and a protective coating covering the conductor pattern together with the row of heating dots;

wherein the protective coating comprises a smaller thickness portion at least at the row of heating dots, and a larger thickness portion held in contact with the resin body and extending to a position short of the row of heating dots.

2. The printhead according to claim 1, wherein the larger thickness portion enters partially into the resin body.

3. The printhead according to claim 1, wherein the protective coating as a whole is made of glass.

4. The printhead according to claim 1, wherein the protective coating comprises a primary layer and a secondary layer formed on the primary layer, the smaller thickness portion of the protective coating being provided by the primary layer alone, the larger thickness portion of the protective coating being provided by a combination of the primary and secondary layers.

5. The printhead according to claim 4, wherein the primary layer has a thickness of 2–6 micrometers, the secondary layer having a thickness of 10–20 micrometers.

6. The printhead according to claim 4, wherein the primary and secondary layers are equally made of a same glass paste which is printed and baked.

7. The printhead according to claim 1, wherein the row of heating dots is provided by a resistor strip.

8. The printhead according to claim 7, wherein the resistor strip is made of ruthenium oxide.

* * * * *